US010919290B2

(12) United States Patent
Xiang et al.

(10) Patent No.: US 10,919,290 B2
(45) Date of Patent: Feb. 16, 2021

(54) DIGITAL INK DUCT FOR A PRESS, DIGITAL INK SUPPLY SYSTEM AND APPLICATION METHOD THEREOF

(71) Applicant: HANGZHOU CRON INTELLIGENT PRINTING TECHNOLOGY CO., LTD, Hangzhou (CN)

(72) Inventors: Jianlong Xiang, Hangzhou (CN); Bo Gao, Hangzhou (CN)

(73) Assignee: HANGZHOU CRON MACHINERY & ELECTRONICS CO., LTD., Hangzhou (CN)

( * ) Notice: Subject to any disclaimer, the term of this patent is extended or adjusted under 35 U.S.C. 154(b) by 144 days.

(21) Appl. No.: 16/075,115

(22) PCT Filed: Jan. 22, 2017

(86) PCT No.: PCT/CN2017/072008
§ 371 (c)(1),
(2) Date: Aug. 2, 2018

(87) PCT Pub. No.: WO2017/133508
PCT Pub. Date: Aug. 10, 2017

(65) Prior Publication Data

US 2019/0039370 A1 Feb. 7, 2019

(30) Foreign Application Priority Data

Feb. 3, 2016 (CN) ..... 201610075723.7
Feb. 3, 2016 (CN) ..... 201610078208.4
(Continued)

(51) Int. Cl.
*B41F 31/08* (2006.01)
*B41F 31/04* (2006.01)
(Continued)

(52) U.S. Cl.
CPC ..... *B41F 31/08* (2013.01); *B41F 31/02* (2013.01); *B41F 31/045* (2013.01); *B41F 33/0027* (2013.01)

(58) Field of Classification Search
CPC ..... B41F 31/08
(Continued)

(56) References Cited

U.S. PATENT DOCUMENTS 5,014,618 A * 5/1991 Zingher ..... B41F 33/0036 101/365
5,967,044 A * 10/1999 Marschke ..... B41F 9/065 101/363
(Continued)

FOREIGN PATENT DOCUMENTS

CN 103481660 1/2014
CN 1034879140 6/2014

*Primary Examiner* — Anthony H Nguyen
(74) *Attorney, Agent, or Firm* — Jiwen Chen; Jacobson Holman PLLC

(57) ABSTRACT

The present invention discloses a digital ink duct for a printing press, comprising an ink tank for storing ink, a main ink pipe that communicates with the ink tank, at least one metering-type ink delivery device, ink delivery pipes, a controller and a signal acquisition device. In the present invention, high-accuracy, metering-type ink delivery devices are arranged in a queue to form a digital ink duct which replaces the traditional ink duct and supplies ink for the ink zones. The present invention can perform accurate adjustment in real time, is high in automation and digitalization degree, and can realize one-way ink delivery and avoid ink return.

5 Claims, 5 Drawing Sheets

(30) Foreign Application Priority Data

Mar. 17, 2016 (CN) ..... 201610156149.8
Mar. 17, 2016 (CN) ..... 201610156192.4

(51) Int. Cl.
*B41F 31/02* (2006.01)
*B41F 33/00* (2006.01)

(58) Field of Classification Search
USPC ..... 101/366
See application file for complete search history.

(56) References Cited

U.S. PATENT DOCUMENTS

| | | | | |
|---|---|---|---|---|
| 2002/0078845 | A1* | 6/2002 | Tokiwa | B41F 31/08 101/365 |
| 2004/0000241 | A1 | 1/2004 | Kiyohara | |
| 2004/0107852 | A1 | 6/2004 | Tafel | |
| 2006/0032387 | A1* | 2/2006 | Watanabe | B41F 5/24 101/366 |
| 2008/0210113 | A1* | 9/2008 | Atwater | B41F 31/04 101/366 |
| 2008/0302260 | A1* | 12/2008 | Atwater | B41F 31/08 101/366 |
| 2013/0327239 | A1* | 12/2013 | Isaac | B41F 31/045 101/450.1 |
| 2014/0158005 | A1* | 6/2014 | Kaya | B41F 31/08 101/366 |

* cited by examiner

DIGITAL INK DUCT FOR A PRESS, DIGITAL INK SUPPLY SYSTEM AND APPLICATION METHOD THEREOF

This is a U.S. national stage application of PCT Application No. PCT/CN2017/072008 under 35 U.S.C. 371, filed Jan. 22, 2017 in Chinese, claiming the priority benefits of Chinese Application No. 201610075723.7, filed Feb. 3, 2016; Chinese Application No. 201610078208.4, filed Feb. 3, 2016; Chinese Application No. 201610156149.8, filed Mach 17, 2016; Chinese Application No. 201610156192.4, filed Mach 17, 2016, all of which are hereby incorporated by reference.

BACKGROUND OF THE INVENTION

1. Technical Field

The present invention belongs to the technical field of printing technology, printing processes, mechanical and electronic control, and digital computing technologies, and specifically relates to an accurate digital ink supply system for a press, the working principle and application methods thereof.

2. Description of Related Art

A printing press is mainly constituted by an ink supply system, an ink distributing mechanism and a printing mechanism. At present, the ink supply system of an ink press employs an ink duct which is equipped with mechanical ink keys as an ink supply device of a single color cell of the press. The ink duct may control the ink keys electrically (motor-driven) or manually (screw-driven, etc.). Usually, an image-text to be printed forms four or more colors through color separation, and color plates are respectively manufactured and then printed in a superimposed way on a printing press to generate a colorful print. Each one of the color cells of the press completes the printing work of a single color. The printing format of each one of the color cells is equally divided into a plurality of ink zones; each one of the color cells is equipped with an ink duct; each one of the ink ducts includes a plurality of ink keys, and each one of the ink keys corresponds to an ink zone. The ink supply amount to each one of the ink zones can be controlled and regulated by adjusting the degree of openness of each corresponding one of the ink keys. During actual printing production, the printed colors are controlled by setting the degree of openness of the corresponding ink keys according to the dot area of each of the dot zones of each single color cell. For an ink zone with a large consumption of ink, the opening of the corresponding ink key needs to be enlarged; on the contrary, for an ink zone with a small consumption of ink, the opening of the corresponding ink key of the ink zone needs to be reduced, or even completely closed. The critical opening and closing points of ink keys are called zero points. The maximum opening of the ink key from zero point defines an opening value. Different press manufacturers set their own respective ranges of opening value. The ink keys are not metering-type control units, and the opening values thereof are relative reference values provided by each press systems.

Ink keys are mechanical products, and the actual opening regulation ranges are very small (usually with the range of 0-0.2 mm), causing relatively large difficulty in the calculation of the zero position and the accurate control of the opening degree. The ink keys of one ink duct are low in consistency. The absolute accuracy and relative accuracy cannot be ensured. Besides the ink duct and the ink key, other mechanical contact and mechanical control methods are also adopted in the ink supply mode and mechanisms of traditional presses to deliver ink, specifically referring to the ink transfer rollers which work in a swinging way, the rotating speed of the ink rollers, the time of contact between the ink rollers and the control accuracy of the actions. These mechanisms and working principles make the calculation, regulation and control of the actual ink supply more difficult and fail to be accurately quantified. To solve the above-mentioned problems, various techniques are adopted in the printing process. Specifically, in some cases, the ink release curve of each ink duct is set to approach the correspondence relationship between the ink supply amount and the opening degree. But they all fail to essentially realize the accurate quantitative control of the ink supply.

For those reasons, the ink supply systems of traditional press work with a "simulated amount" and a qualitative method. Whether the ink supply amount is "excessive" or "insufficient" can only be judged through detection of the print, and the actual ink supply amount is unknown. The regulation of the ink supply amount is based on experience and tests, so the efficiency is low.

BRIEF SUMMARY OF THE INVENTION

Aiming at the above-mentioned problems of the current ink supply system which employs mechanical ink keys to control the ink supply, an object of the present invention is to provide a digital ink duct for a printing press and further provide a digital ink supply system for a printing press and the application methods thereof.

To solve the above mentioned problems, the present invention adopts the following technical solutions.

A digital ink duct for a printing press, comprising an ink tank for storing ink, a main ink pipe which communicates with the ink tank, at least one metering-type ink delivery device, ink delivery pipes, a controller and a signal acquisition device, wherein the ink input end of each metering-type ink delivery device communicates with the main ink pipe, each of the ink output end of each metering-type ink delivery device is connected with one end of each corresponding one of the ink delivery pipes, the other end of each corresponding one of the ink delivery pipes outputs ink; wherein the metering-type ink delivery devices take either volume or mass as the metering basis, each one of the metering-type ink delivery devices corresponds to an ink zone, the signal acquisition device acquires the starting and stopping state signals of the press and the printing speed signal of the press and outputs the acquired signals to the controller, and the controller respectively controls the starting and stopping of each of the metering-type ink delivery devices and the ink output flows.

In the present solution, each one of the controllers accepts the setting and control by the process management module through the communication network, stores the running data of each corresponding one of the digital ink ducts, and at the same time, receives data signals from each corresponding one of the signal acquisition devices, thus controlling and driving each corresponding one of the metering-type ink delivery devices to output ink quantitatively and continuously.

The output quantities can be under quantitative control, and the medium output quantities and the output capabilities of the metering-type ink delivery devices can be calculated according to the respective structure shapes and sizes thereof. The delivery devices are selected from any one of the plunger pump, injection pump, peristaltic pump, gear pump and screw pump, with a metering function. When the plunger pump or the injection pump is selected, each one of the metering-type ink delivery devices may control the running speed of a piston to control the output flow of the ink, and calculate the ink output according to the cross section of a piston cavity and a moving distance of the piston.

When a plurality of the metering-type ink delivery devices are provided, the plurality of metering-type ink delivery devices are arrayed along the printing format.

Further, the ink input end of each metering-type ink delivery device is in a sealing connection with an ink outlet of the main ink pipe, and the output end of each metering-type ink delivery device is connected with one end of each corresponding one of the ink delivery pipes; and each metering-type ink delivery device sucks ink from the main ink pipe and outputs ink via each corresponding one of the ink delivery pipes.

In order to protect the ink supply system, a protective hood is disposed preferably outside the main ink pipe and a plurality of the metering-type ink delivery devices; the controller and the signal acquisition device are disposed in the protective hood; the digital ink ducts are fixed on main wall boards of the press.

Further, the ink tank is provided with an air pressure valve, and the air pressure valve is connected with an external air pressure pipe, with its output end being connected with one end of the main ink pipe. Further, the other end of the main ink pipe is provided with a pressure meter for monitoring the internal pressures of the ink delivery pipes. Further, the ink tank is a pressure vessel, and the ink in the ink tank is boosted by pressurized air and then flows into the main ink pipe through the output end. The ink is delivered in a fully enclosed environment, which means that starting from each one of the ink tanks, the ink is isolated from the air during the process of flowing to the ink outlet of each corresponding one of the ink delivery pipes via each corresponding one of the main ink pipe and each corresponding one of the metering-type ink delivery devices, and the whole delivery pipeline is in a positive pressure condition inside.

Based on the above digital ink duct, the present invention further provides a digital ink supply system for a printing press, that comprises a process management module and digital ink ducts. A digital ink duct is installed in each one of the single-color printing units of the press. Each one of the digital ink ducts includes at least one of the metering-type ink delivery devices; the metering-type ink delivery devices take either volume or mass as the metering basis, and each one of the metering-type ink delivery devices corresponds to an ink zone. The process management module calculates the ink demand of the respective ink zones when a single printed sheet is printed in each one of the single-color printing units, according to the image data of a pattern to be printed, and outputs the ink demand of the respective ink zone of a single printed sheet to the digital ink duct in the corresponding single-color printing unit. Each one of the digital ink ducts controls the respective metering-type ink delivery devices to output ink respectively and quantitatively according to the ink demand of the respective ink zone in a single printed sheet that are input by the process management module.

The ink demand is calculated through multiplying the dot area on the printing plate by a required ink layer thickness.

The calculation of the ink demand is based on platemaking image data. In specific, the process management module reads in the bitmap images of the respective color plates, calculates and obtains the ink demand of each one of the ink zones in a printed sheet, and transmits the calculated ink demand of each one of the ink zones in a printed sheet to the digital ink duct of the corresponding single color printing set.

Further, the digital ink duct for a printing press includes an ink tank for storing ink, a main ink pipe which communicates with the ink tank, at least one metering-type ink delivery device, ink delivery pipes, a controller and a signal acquisition device, wherein the ink input end of each metering-type ink delivery device communicates with the main ink pipe, the ink output end of each metering-type ink delivery device is connected with one end of each corresponding one of the ink delivery pipes, the other end of each corresponding one of the ink delivery pipes outputs ink; wherein the controllers communicate with the process management module; the signal acquisition devices acquire the starting and stopping state signals of the press and the printing speed signal of the press, and output the acquired signals to the corresponding controllers; the controllers control the starting and stopping of the corresponding metering-type ink delivery devices according to the starting and stopping state signals of the press that are acquired by the corresponding signal acquisition devices; the controllers control the ink output flows of the respective ink delivery devices according to the ink demand of the respective ink zones, that are input by the process management module, in a single printed sheet of a corresponding one of the single-color printing units, and the printing speeds of the press that are input by the signal acquisition devices.

Preferably, a plurality of metering-type ink delivery devices are included, and the plurality of metering-type ink delivery devices are arrayed along a printing format.

Similarly, each one of the metering-type ink delivery devices is selected from any one of the plunger pump, injection pump, peristaltic pump, gear pump and screw pump, with a metering function. When a plunger pump or an injection pump is selected, each one of the metering-type ink delivery devices controls the running speed of a piston to control the output flow of the ink, and determines the ink output quantities according to the cross section of a piston cavity and a moving distance of the piston.

Further, the ink input end of each metering-type ink delivery device is in a sealing connection with an ink outlet of the main ink pipe, and the output end of each metering-type ink delivery device is connected with one end of each corresponding one of the ink delivery pipes; and each metering-type ink delivery device sucks ink from the main ink pipe and delivers ink to each corresponding one of the ink delivery pipes. The other end of each one of the ink delivery pipes is disposed between an ink transfer roller and a vibrating roller, and may also be disposed between other rollers, for the purpose of directly delivering the ink into an ink path.

Further, each one of the ink tanks is a pressure vessel; each one of the ink tank is provided with a gas pressure valve; each one of the gas pressure valves is connected with an external pressurized air pipe and has an output end which is connected with one end of each corresponding one of the main ink pipes; the ink in each one of the ink tanks is boosted by the pressurized air, and flows into each corresponding one of the main ink pipe via the corresponding output end, and then is delivered into an inlet ink of each corresponding one of the metering-type ink delivery devices. Further, the other end of the main ink pipe is provided with a pressure meter for monitoring the internal pressures of the ink delivery pipes. Starting from each one of the ink tanks, the ink is isolated from the air during the process of flowing to the ink outlet of each corresponding one of the ink delivery pipes via each corresponding one of the main ink pipes and each corresponding one of the metering-type ink delivery devices, and the whole delivery pipeline is in a positive pressure state inside.

The process management module may be disposed on the printer and connected with the control module through a data interface, and may also be disposed at an individual control terminal. The control terminal may be locally arranged and connected with the press through a data cable, or be remotely located and communicate with the digital ink ducts through a communication network. Specifically, the control terminal may also be a PC or other computing device with corresponding functions, and may also be an individually developed hardware device.

Usage of the accurate digital ink supply method for a printing press is specifically as follows.

The process management module is capable of reading image data, calculates and obtains the ink demand of each one of the ink zones of each one of the color plates of a single printed sheet according to the image data, and then transmits the ink demand to each corresponding one of the digital ink ducts via the communication network. Each one of the digital ink ducts supplies ink accurately in a metering way according to the ink demand. Each one of the digital ink ducts acquires the running data of the press through each corresponding one of the signal acquisition devices; each one of the controllers respectively sets an ink flow rate for each corresponding one of the metering-type ink delivery devices in each corresponding one of the digital ink ducts and performs adjustment in real time according to the running speed of the press. Specifically, during the printing process, bitmap images of the respective color plates that are generated after RIP color separation are used to manufacture printing plates, while the printing plates are installed in the press; at the same time, the process management module reads in the bitmap images of the respective color plates, calculates and obtains the ink demand of each one of the ink zones in a printed sheet, and transmits the calculated ink demand to the corresponding controllers for storage via the communication network; each one of the signal acquisition devices continuously monitors the field signal and data of the press, and transmits the signal data to the process management module and each corresponding one of the controllers in real time via the communication network; when the press performs the printing operation practically, each one of the controllers drives each corresponding one of the metering-type ink delivery devices to deliver ink to each corresponding one of the ink zones according to the respective set flow rate, and adjusts the flow rate of each corresponding one of the metering-type ink delivery devices in real time according to the printing speed; and when the press stops printing, each one of the controllers stops the ink delivery action of each corresponding one of the metering-type ink delivery devices.

The present invention has the following beneficial effects:

The method of the present invention realizes accurate quantitative control over the ink supply to the press, and by adopting the high-performance metering-type ink delivery device, the quantitative resolution may reach 0.2 ml (cubic millimeter).

In the present invention, high-accuracy, metering-type ink delivery devices are arranged in a queue to form a digital ink duct which replaces the traditional ink duct; the metering-type ink delivery devices replaces the traditional ink keys to supply ink to respective ink zones. According to the actual printing action of the press, the ink required for printing a sheet is supplied each time a sheet is printed, and the metering is based on the ink volume or mass. In modern printing processes, the printing process has been digitalized, and the process management module can accurately calculate the theoretical ink amount according to the image-text information and the actual printing conditions (for example, printed sheet, ink variety, etc.) According to the press field data (for example current printing speed, starting and stopping of the actual printing production, etc.), the controller performs automatic control over each one of the ink delivery devices of each one of the color cells of the press, and accurately supplies ink in real time according to the actual ink demand of each corresponding one of the ink zones. For ink supply with the method of the present invention, the actual supply is calculated and accurately controlled, and can be precisely adjusted in real time. The present invention is high in automation and digitalization degree and large in adjustable range, realizes one-way ink delivery, avoids ink return, and well solves the shortcomings and defects of the traditional press.

At the same time, the present invention enhances the automation and intelligence level of the operation and use of the press, and decreases the dependence on the personal skills and experience of the press operators; the accurate digital ink supply method enhances the overall performance of the press, enhances the print quality, maintains stable quality and ensures the consistency in quality of the sheet turning operation; the accurate digital ink supply method shortens the preparation time before the press starts to work and the commissioning time during operation switching, and reduces the waste of paper and ink caused by commissioning of the press; the ink is delivered in a one-way mode in a fully enclosed environment without circulating reflux, thus avoiding ink contamination and waste; and the enclosed ink delivery reduces the workload in equipment maintenance and cleaning.

Figure 1:
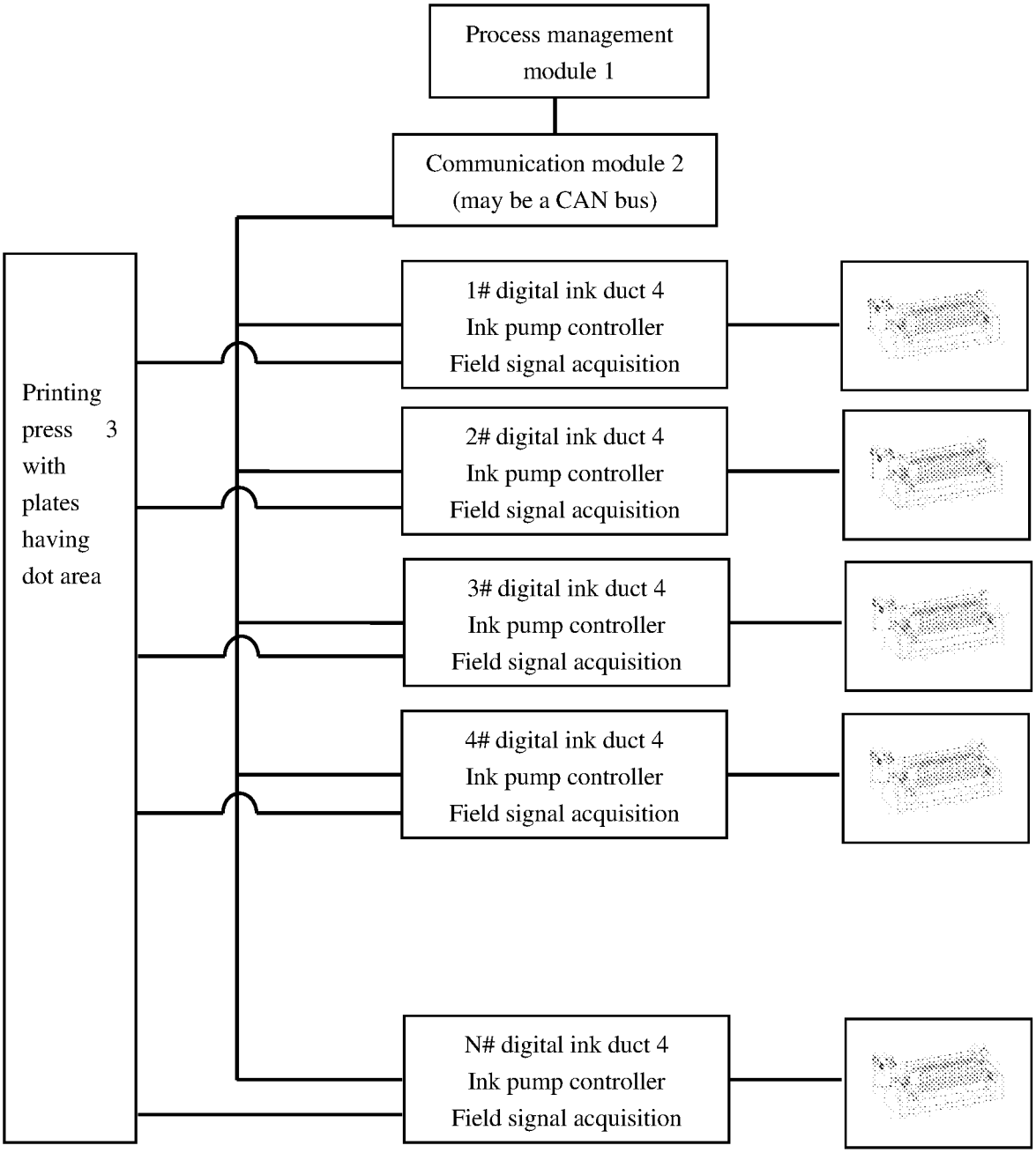
FIG. 1 is a schematic diagram of a digital ink supply system for a printing press.

As shown in the drawings, process management module 1, communication network 2, press 3, digital ink duct 4, ink tank 5, gas pressure valve 6, fast-mounting ball valve 7, main ink pipe 8, hood 9, ink delivery pipe 10, pressure meter 11, mounting bracket 12, ink transfer roller 13, vibrating roller 14, press main wallboard 15, metering-type ink delivery device 16, controller 17, signal acquisition device 18, housing 1001, pump shaft sleeve 1002, injection shaft 1003, sealing baffle 1004, sealing ring 1005, sealing device 1006, screw 1007, shaft sleeve medium inlet end 1001-1, shaft sleeve medium outlet end 1001-2, screw motor 1008, clutch disc 1091, electromagnetic clutch component I 1092, electromagnetic clutch component II 1093, sensor shield 1094, clutch bracket 1010, screw sensor 1101, steering sensor 1102.

DETAILED DESCRIPTION OF THE INVENTION

Embodiment 1

As shown in FIG. 1, the present invention comprises a process management module 1, a communication network 2 and a plurality of the digital ink ducts 4.

The digital ink ducts 4 are actuators, respectively installed in the single-color printing units of the press 3, and disposed between the main wall boards of the press, which means that the digital ink ducts are installed at the ink duct positions of the traditional press so as to replace the traditional ink duct device of the press.

The process management module 1 is disposed in a PC. The process management module 1 exchanges data with the digital ink duct(s) 4 and performs control through the communication network 2. The process management module 1 is capable of reading image data, calculates and obtains the ink demand of each one of the ink zones of each one of the color plates of a single printed sheet according to the image data. The process management module 1 transmits the data to each corresponding one of the digital ink ducts 4 via the communication network 2.

The communication network 2 is responsible for connecting the process management module 1 and the digital ink duct 4 so as to transmit data; specifically, the communication network 2 may be a CAN bus.

Each one of the digital ink ducts 4 includes an ink tank 5, a fast-mounting ball valve 7, a main ink pipe 8, a housing 9, ink delivery pipes 10, a pressure meter 11, a mounting bracket 12, metering-type ink delivery devices 16, a controller 17 and a signal acquisition device 18.

Each one of the digital ink ducts 4 acquires the running data of the press 3 through each corresponding one of the signal acquisition devices 18; the control module 17 respectively sets an ink flow rate for each one of the metering-type ink delivery devices 16 in each one of the digital ink ducts 4 and makes regulations in real time according to the running speed of the press; and during practical printing, the control module 17 drives all metering-type ink delivery devices 16 to deliver ink to the corresponding ink zones according to respective set flow rates. Each one of the ink tanks 5 is a pressure vessel for storing ink, is provided with an air pressure valve 6, and is connected with an external pressure air pipe. The output end of each one of the ink tanks 5 is connected with one end of each corresponding one of the main ink pipes 8 through each corresponding one of the fast-mounting ball valves 7, while the other end of each corresponding one of the main ink pipes 8 is provided with a pressure meter 11 for monitoring the internal pressure of each corresponding one of the ink delivery pipes; and the ink in each one of the ink tanks 5 is boosted by air pressure and then flows into each corresponding one of the main ink pipes 8 through the output end.

Each one of the metering-type ink delivery devices 16 is provided on each corresponding one of the main ink pipes 8, and the ink input end of each one of the metering-type delivery devices 16 is in sealing connection with an ink outlet of each corresponding one of the main ink pipes 8; the output end of each one of the metering-type ink delivery devices 16 is connected with one end of each corresponding one of the ink delivery pipes 10, while the other end of each corresponding one of the ink delivery pipes 10 is disposed between each corresponding one of an ink transfer rollers 13 and each corresponding one of the vibrating rollers 14; a mounting bracket 12 which is connected with the main wall boards of the press 15 is disposed at the bottom surfaces of the two ends of each one of the main ink pipes; and each one of the main ink pipes is fixed on the main wall boards of the press 15 through each corresponding one of the mounting brackets 12. Each one of the main ink pipes is a run-through pipe with two open ends, and the top surface is a plane formed with a plurality of ink outlets; each one of the ink outlets of each one of the main ink pipes is in a sealing connection with an ink input end of each corresponding one of the metering-type ink delivery devices 16. A protective hood 9 is disposed outside each one of the main ink pipes and a plurality of corresponding metering-type ink delivery devices 16; each one of the hoods 9 is formed with a through-hole for penetration by each corresponding one of the ink delivery pipes; and each one of the metering-type ink delivery devices 16 sucks ink from each corresponding one of the main ink pipes 8 and injects the ink into corresponding one of the ink zones through each corresponding one of the ink delivery pipes 10.

Each one of the hoods 9 is internally provided with the controller 17 and the signal acquisition device 18; each one of the controllers 17 receives the setting and control from the process management module 1 via the communication network 2, stores the running data of each corresponding one of the digital ink ducts 4, receives the data signal from each corresponding one of the signal acquisition devices 18, thus controlling and driving each corresponding one of the metering-type ink delivery devices 16 to quantitatively and continuously output ink.

Figure 2:
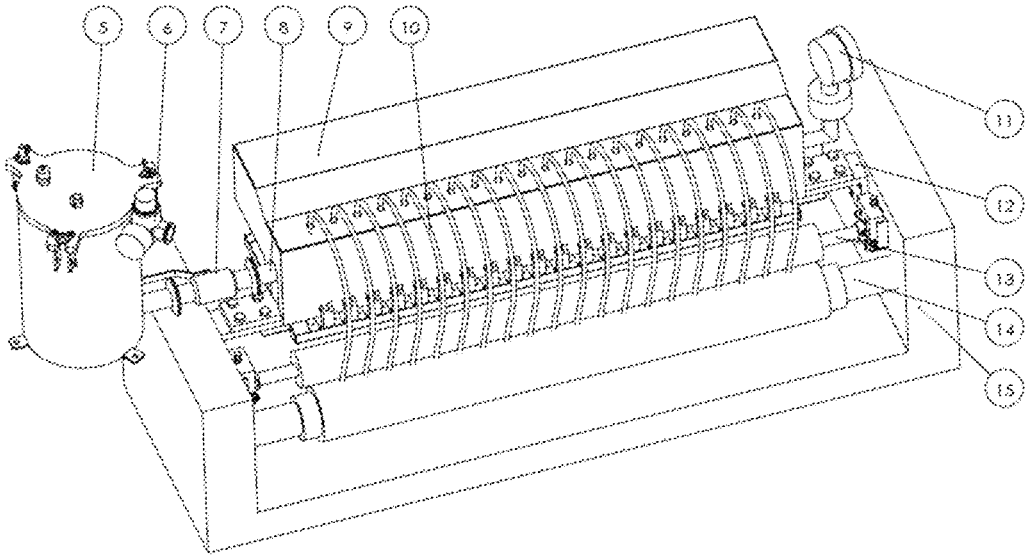
FIG. 2 is a view of entire appearance/installation of a digital ink duct.
Figure 3:
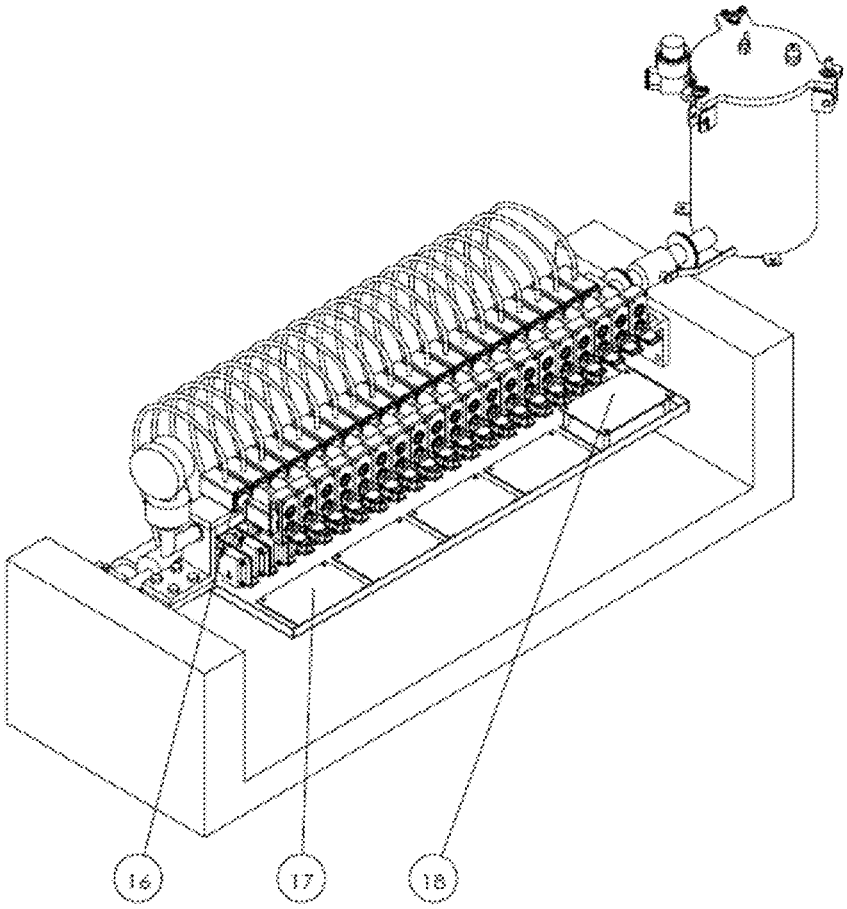
FIG. 3 is a schematic view of an internal structure of the digital ink duct.

The signal acquisition devices 18 acquire the field information and data of the printing units, as shown in FIG. 1. FIG. 2 and FIG. 3. Sensors are provided in the press 3, specifically for acquiring press-fit signals, ink delivery signals, rotating speeds of the pressing rollers (printing speed), etc., and sending the acquired signals to the controller 17 and the process management module 1.

As shown in FIG. 2 and FIG. 3, each one of the ink tanks 5 stores a certain amount of ink, delivers the ink to each one of the metering-type ink delivery devices 16 via the main ink pipe 8, and communicates with the media inlet terminal of each one of the metering-type ink delivery devices 16.

As shown in FIG. 2 and FIG. 3, each one of the metering-type ink delivery devices 16 is selected from any one of the plunger pump, injection pump, peristaltic pump, gear pump and screw pump, with a metering function. Each one of the metering-type ink delivery devices 16 outputs ink by taking either volume or mass as the metering basis. The metering-type ink delivery devices 16 deliver ink in a designed way or stop ink delivery under the command of the controller 17; the metering-type ink delivery devices 16 are arrayed along the printing format; each one of the metering-type ink delivery devices 16 corresponds to an ink zone, and the output ink is directly delivered into the corresponding ink zone.

As shown in FIGS. 1-3, the digital ink ducts 4 deliver ink, the ink delivery environment is relatively enclosed, which means that the ink is isolated from air in the process of flowing from each one of the ink tanks 5 to the ink outlets of each corresponding one of the ink delivery pipes 10 via each corresponding one of the fast-mounting ball valves 7, main ink pipes 8 and metering-type ink delivery devices 16, and the whole delivery pipeline is in a positive pressure state inside.

In the printing process, the bitmap images of the respective color plates generated through RIP color separation treatment are used to manufacture the printing plates, and the printing plates are installed in the press 3. At the same time, the process management module 1 reads in the bitmap images, calculates and obtains the ink demand of each one of the ink zones in a printed sheet, and transmits the calculated ink demand to the corresponding controllers 17 for storage via the communication network 2. Each one of the signal acquisition devices 18 continuously monitors the field signal and data of the press 3, transmits the signal data via the communication network 2 to the process management module 1 and each corresponding one of the controllers 17 in real time. When the press 3 performs printing practically, the controller 17 drives the metering-type ink delivery devices 16 to supply ink and regulates the flow rates of the metering-type ink delivery devices 16 in real time according to the printing speed. When the press 3 stops printing, the controller 17 stops the ink delivery actions of the metering-type ink delivery devices 16.

Embodiment 2

The implementation of the metering-type ink delivery device of the present invention is explained and described below by taking an injection pump mechanism as an example.

Figure 4:
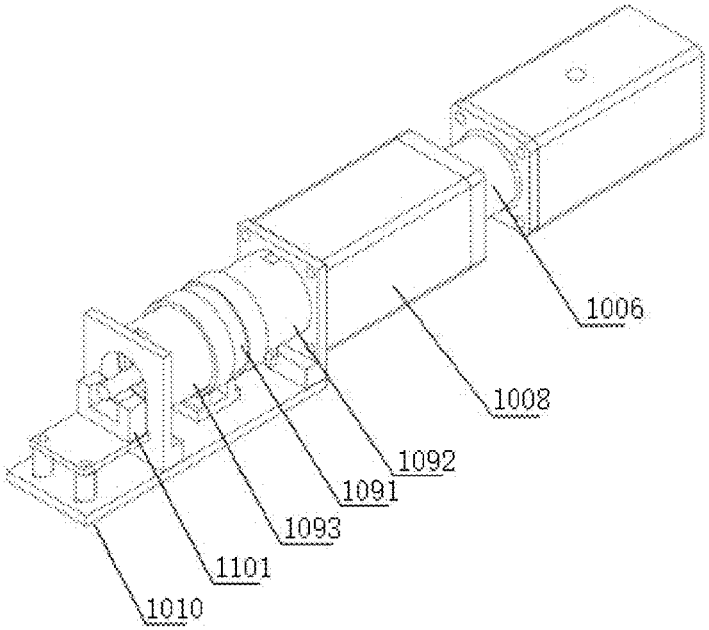
FIG. 4 is a structural view of a printing press a specific embodiment (injection pump mechanism) of a metering-type ink delivery device.
Figure 5:
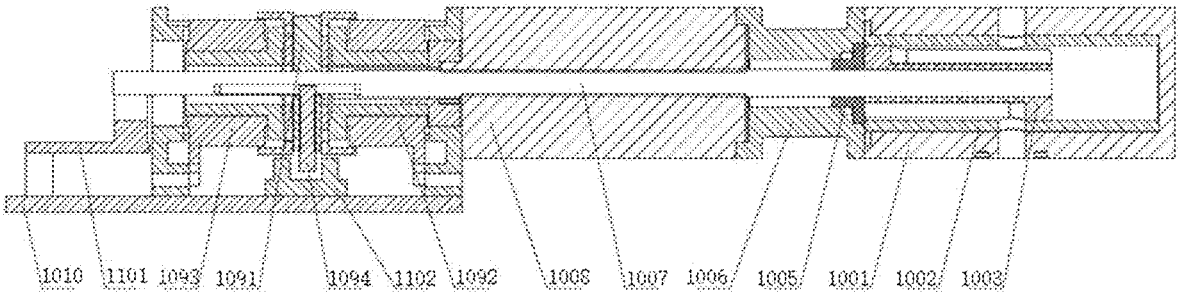
FIG. 5 is a sectional view of the injection pump mechanism as shown in FIG. 4.
Figure 6:
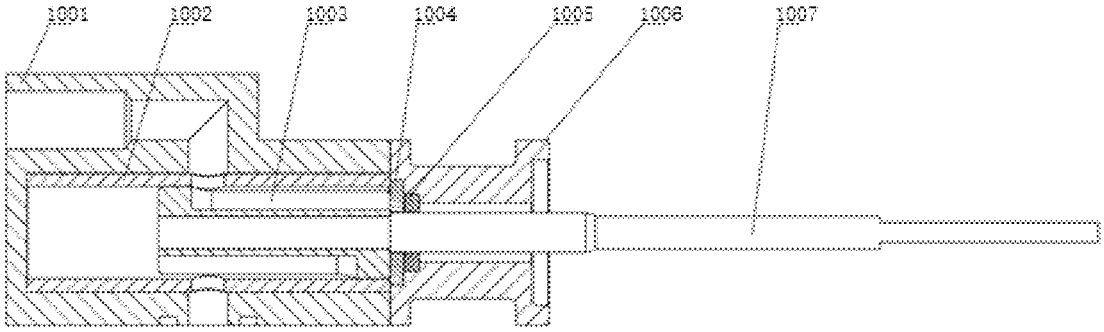
FIG. 6 is a structural view of a single-pipe, dual-cavity injection pump of the injection pump mechanism.
Figure 7:
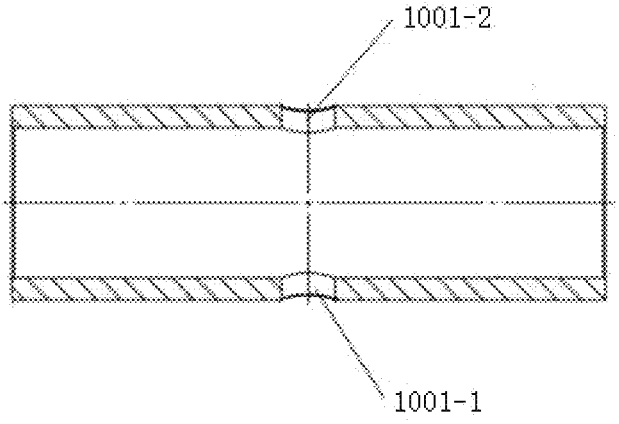
FIG. 7 is a structural sectional view of a pump shaft sleeve of the single-pipe dual-cavity injection pump of the injection pump mechanism.
Figure 8:
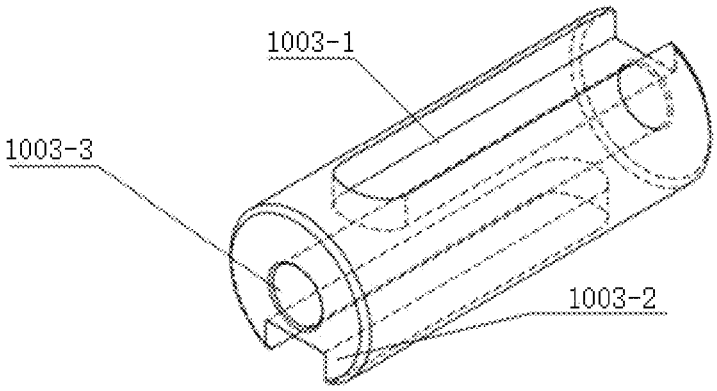
FIG. 8 is a structural view of an injection shaft of the single-pipe dual-cavity injection pump of the injection pump mechanism.
Figure 9:
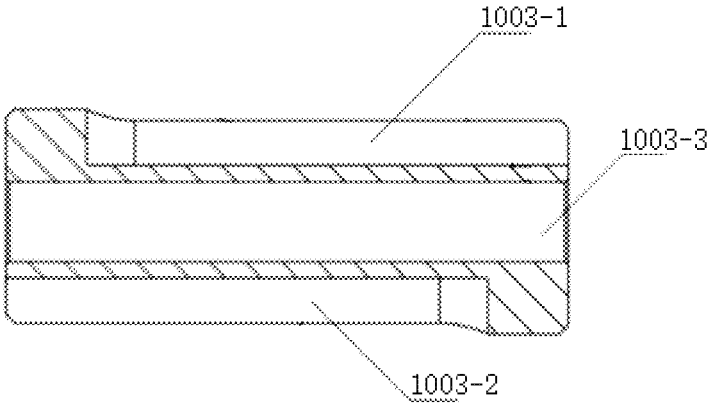
FIG. 9 is a structural sectional view of an injection shaft of the single-pipe dual-cavity injection pump of the injection pump mechanism.
Figure 10:
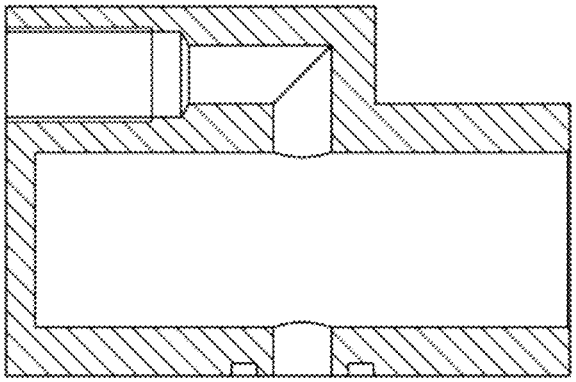
FIG. 10 is a structural view of a housing of the single-pipe, dual-cavity injection pump of the injection pump mechanism.

The injection pump mechanism (metering-type ink delivery device) as shown in FIGS. 4-5 is under the control of a single motor, and includes a single-pipe dual-cavity injection pump, a screw motor 1008, a clutch device, an induction device and a control device. The screw motor 1008 is respectively connected with the single-pipe dual-cavity injection pump and the clutch device on two sides through a screw 1007.

The single-pipe dual-cavity injection pump as shown in FIGS. 6-10 includes a pump shaft sleeve 1002, an injection shaft 1003, a housing 1001 and a sealing device 1006. The pump shaft sleeve 1002 is symmetrically formed with a shaft sleeve medium inlet end 1001-1 and a shaft sleeve medium outlet 1001-2 at the middle position. The outside wall of the injection shaft 1003 is formed with two long slots, namely an injection shaft slot 1003-1 and an injection shaft slot 1003-2. One end of each one of the two slots is enclosed, while the other end is open, and the two open ends are respectively leveled with the two ends of the injection shaft 1003. The injection shaft slot 1003-1 and the injection shaft slot 1003-2 are symmetric to each other at the center of the middle section of the injection shaft 1003.

The housing 1001 is formed with a cylindrical hole at one end. The pump shaft sleeve 1002 is disposed in the cylindrical hole. The injection shaft 1003 is disposed in the pump shaft sleeve 1002. One end of the pump shaft sleeve 1002 is in a sealing connection with the sealing device 1006 such that one end face of the injection shaft 1003, the inside wall of the pump shaft sleeve 1002 and the sealing device 1006 form a first cavity, while the other end face of the injection shaft 1003, the inside wall of the pump shaft sleeve 1002 and the inner bottom face of the cylindrical hole on the housing 1001 form a second cavity. The injection shaft 1003 can axially move back and forth in the pump shaft sleeve 1002, thereby changing the volumes of the two cavities.

The injection shaft 1003 is centrally formed with a through-hole 1003-3. One end of the screw 1007 runs through the through-hole 1003-3 and the sealing device 1006; the screw 1007 is closely connected with the inside wall of the injection shaft, and at the same time, the screw 1007 is in a sealing connection with the sealing device 1006. The rotation and movement of the injection shaft 1003 are linked with the screw 1007.

The housing 1001 is disposed outside the pump shaft sleeve 1002, and the housing 1001 is provided with an inlet and an outlet that respectively communicate with the shaft sleeve medium inlet end 1001-1 and the shaft sleeve medium outlet end 1001-2. The housing 1001 is internally provided with a medium inlet channel and a medium outlet channel that respectively communicate with the shaft sleeve medium inlet end 1001-1 and the shaft sleeve medium outlet end 1001-2. The inner wall of the cylindrical hole of the housing 1001 is sealed with the outer wall of the pump shaft sleeve 1002, and the inner bottom face of the cylindrical hole of the housing 1001 plays the role of sealing one end face of the pump shaft sleeve 1002.

The sealing device 1006 is provided with a sealing baffle 1004 and a sealing ring 1005. The sealing ring 1005 is closely connected with the screw 1007. The sealing device 1006 is in a closed fit connection with the sealing housing 1001 through the sealing baffle 1004, playing the role of sealing the other end face of the pump shaft housing 1002.

The sealing device 1006 is also provided with symmetric medium overflow holes such that overflowing medium can flow out via the overflow holes on the sealing device 1006 instead of directly reaching the motor via the screw 1007.

The pump shaft sleeve 1002 and the injection shaft 1003 are both made of a ceramic material. The housing 1001 and the sealing device 1006 are both made of a metal material, such as aluminum or steel.

The screw motor 1008 is connected with the control unit, and controls the startup or stop of the screw motor 1008. The clutch device includes a clutch disc 1091 and an electromagnetic clutch component I 1092 and an electromagnetic clutch component II 1093 that are respectively disposed on two sides of the clutch disc 1091, wherein the two electromagnetic clutch components are respectively electrically connected with the control device, and after being electrified the electromagnetic clutch components can adsorb the clutch disc. The two electromagnetic clutch components are equipped and secured through a clutch bracket 1010, and are fastened and equipped with the screw motor 1008. The electromagnetic clutch component I 1092 on the side close to the screw motor 1008 is provided with a rotor in the center, and the rotor is equipped and connected with the screw motor 1008 to form a rotation pair. When the motor rotor rotates, the rotor in the electromagnetic clutch component I is linked to rotate synchronously.

The induction device includes two optical coupling sensors, namely a steering sensor 1102 and a screw sensor 1101, and the two optical coupling sensors are respectively connected with the control device to perform signal transmission. The screw sensor 1101 is disposed at the clutch bracket on the outer side of the electromagnetic clutch component II, and when the screw motor 1008 drives the screw 1007 to move axially to a set position, a screw position signal is triggered.

One section of the screw 1007 that is matched with the clutch device is shaped as a flat wire on a single side. The straight-lined bottom edge of a sensor shield 1094 which is inserted into an interlayer of the clutch disc 1091 is matched with the flat-wire face of the screw 1007 such that the clutch disc 1091 and the screw 1007 form a rotation pair. The clutch disc 1091 drives the screw 1007 to rotate synchronously when rotating around the screw 1007. The sensor shield 1094 is used to trigger the rotation position signal. The steering sensor 1102 is disposed on the clutch bracket below the sensor shield 1094. The sensor shield 1094 is semi-round, fixedly disposed in the interlayer of the clutch disc 1091, and has a radius greater than the radius of the clutch disc 1091. The part of the sensor shield that protrudes out of the outer diameter of the clutch disc 1091 can shield the steering sensor 1102 to trigger the signal. When the screw motor 1008 is rotated to the clutch disc 1091, the sensor shield 1094 rotates as well. The radial bottom sides of the sensor shield 1094 are respectively disposed on the two sides of the outer diameter of the clutch disc 1091, forming two signal triggering points for the steering sensor 1102. The two points are in a 180 DEG angle relation. When any one of the two edges passes through the steering sensor 1102, the corresponding signal is triggered, and the signal is used by the control device to determine the two stop positions during the steering process.

The two electromagnetic clutch components in the clutch device are controlled by the control device. The control device maintains only one electromagnetic clutch component electrified, and after being electrified, the electromagnetic clutch component generates an electromagnetic field, adsorbs and integrates with the clutch 1091. When the clutch disc 1091 is integrated through adsorption with the electromagnetic clutch component I 1092 with a rotor, the clutch disc is indirectly integrated with the screw motor 1008, and is driven by the screw motor 1008 to rotate as well, thus driving the screw 1007 and the injection shaft 1003 to rotate along with the screw motor 1008. When the clutch disc 1091 is adsorbed with the electromagnetic clutch component II 1093 on the other side, the clutch disc is indirectly integrated with the clutch bracket 1010 and kept still relatively, thus preventing the screw 1007 and the injection shaft 1003 from rotating.

In this embodiment, the operation method of the injection pump mechanism includes the following steps.

(1) The inlet and outlet on the housing 1001 of the single-pipe dual-cavity injection pump are respectively in a sealing connection with an external medium input device and an external medium output device.

(2) The control device, through cooperation among the clutch device, the screw motor 1008 and the induction device, places the single-pipe dual-cavity injection pump in the resetting direction, which means that the first cavity communicates with the medium outlet end through the slot on one side of the injection pump shaft 1003, while the second cavity on the other side communicates with the medium inlet end through the slot on the other side of the injection shaft 1003. The two slots of the injection shaft 1003 respectively face the medium inlet end and the medium outlet end of the pump shaft sleeve.

(3) The control device electrifies the electromagnetic clutch component II 1093. The clutch disc 1091 is adsorbed to the electromagnetic clutch component II 1093. The clutch device locks the degree of freedom of the axial rotation of the screw 1007, and pulls, through the screw motor 1008, the screw 1007 and the injection shaft 1003 to move toward the screw motor 1008, so that the volume of the first cavity is reduced, and the medium (air or a mixture of air and the medium at the beginning) is pumped out via the outlet; at the same time, the volume of the second cavity on the other side is increased, and the medium is absorbed into the cavity via the inlet on the same side.

(4) When the screw motor 1008 pulls the injection shaft 1003 to axially move to and approach the end face of the sealing device 1006, the tail end of the screw 1007 triggers the screw sensor 1101, and the screw sensor 1101 transmits the signal to the control device. The control device electrifies the electromagnetic clutch component I 1092, and when the clutch disc 1091 is integrated with the electromagnetic clutch component I 1092 through adsorption, the clutch disc is indirectly integrated with the rotor of the screw motor 1008 and is driven by the screw motor 1008 to rotate as well. The sensor shield 1094 triggers the steering sensor 1102 such that the screw 1007 and the injection shaft 1003 axially rotate 180 DEG, and the slots on two sides of the injection shaft 1003 are exchanged in position, wherein the slot that originally directly faced the medium inlet end is turned to directly face the medium outlet end, and the medium cavity communicates with the slot is full of medium and communicates with the medium outlet end; the other slot that originally directly faced the medium outlet end is turned to direct face the medium inlet end, and the medium cavity communicating with this lot drains the medium and communicates with the medium inlet end.

(5) The control device 1011 electrifies the electromagnetic clutch component II 1093, and the clutch disc 1091 is adsorbed to the electromagnetic clutch component II 1093 to lock the degree of freedom of the axial rotation of the screw 1007. The screw motor 1008 rotates in the reverse direction, so that the screw 1007 and the injection shaft 1003 are pushed away from the screw motor 1008. In this way, the volumes of the cavities on two sides of the injection shaft 1003 are changed, so that the cavity on one side pumps out the medium while the cavity on the other side absorbs the medium, and at the same time the control device starts accumulating the journeys of the injection shaft 1003 and the screw 1007.

(6) When the injection shaft 1003 is pushed away from the set journey, the control device stops the injection pump from pumping medium out; the control device implements a steering action, and through cooperation among the clutch device, the screw motor and the induction, places the injection pump in the resetting direction again. The cycle is repeated. Except for a short stop during the execution of the steering action, the single-pipe dual-cavity injection pump mechanism can continuously pump out the medium without stop.

What is claimed is:

1. A digital ink supply system for a printing press, comprising a process management module and a plurality of single-color printing units, wherein a digital ink duct is installed in each one of the single-color printing units of the printing press;

wherein each one of the digital ink ducts comprises an ink tank for storing ink, a main ink pipe which communicates with the ink tank, a plurality of metering-type ink delivery devices, a plurality of ink delivery pipes, a plurality of controllers, and a plurality of signal acquisition devices;

wherein an ink input end of each one of the metering-type ink delivery devices communicates with the main ink pipe, an ink output end of each one of the metering-type ink delivery devices is connected with one end of each corresponding one of the ink delivery pipes, the other end of each corresponding one of the ink delivery pipes outputs ink;

the metering-type ink delivery device takes volume or mass as the metering basis, each metering-type ink delivery device corresponds to one ink zone;

the controllers communicate with the process management module; the signal acquisition devices acquire starting and stopping state signals of the printing press and printing speed signals of the printing press, and output the acquired signals to the corresponding controllers; the controllers control starting and stopping of the corresponding metering-type ink delivery devices according to the starting and stopping state signals of the printing press that are acquired by the corresponding signal acquisition devices;

the controllers control the ink output flows of the corresponding ink delivery devices according to the ink demands of the corresponding ink zones, that are input by the process management module, in a single printed sheet of a corresponding one of single-color printing units, and the printing speeds of the printing press that are input by the signal acquisition devices;

the ink tank is provided with an air pressure valve, and the air pressure valve is connected with an external air pressure pipe and has an output end which is connected with one end of the main ink pipe; other end of the main ink pipe is provided with a pressure meter for monitoring the internal pressures of the ink delivery pipes;

the ink input end of each metering-type ink delivery device is in a sealing connection with an ink outlet of the main ink pipe, and the output end of each metering-type ink delivery device is connected with one end of each corresponding one of the ink delivery pipes; and each metering-type ink delivery device sucks ink from the main ink pipe and outputs ink via each corresponding one of the ink delivery pipes;

the process management module calculates the ink demand of the respective ink zones of a single printed sheet to be printed in each one of the single-color printing units, according to the image data of a pattern to be printed, and outputs the ink demand of the corresponding ink zone of a single printed sheet to the digital ink duct in the corresponding single-color printing unit;

each one of the digital ink ducts controls the respective metering-type ink delivery devices to respectively and quantitatively output ink according to the ink demand of the corresponding ink zone in a single printed sheet that are input by the process management module;

wherein each one of the metering-type ink delivery devices is an injection pump, and each one of the metering-type ink delivery devices controls the running speed of a piston to control the output flow of the ink, and calculates the ink output according to the cross section of a piston cavity and a moving distance of the piston;

wherein the injection pump comprises a single-pipe dual-cavity injection pump, a screw motor, a clutch device and wherein the screw motor is respectively connected with the single-pipe dual-cavity injection pump and the clutch device on two sides through a screw;

wherein the single-pipe dual-cavity injection pump comprises a pump shaft sleeve, an injection shaft (1003), a housing and a sealing device;

wherein the pump shaft sleeve is symmetrically formed with a shaft sleeve medium inlet end and a shaft sleeve medium outlet at a middle position, an outside wall of the injection shaft includes two parallelly arranged elongated injection grooves (1003-1, 1003-2); one end of each one of the two elongated injection grooves is enclosed, while the other end is open, and the two open ends of the two elongated injection grooves are respectively leveled with two ends of the injection shaft (1003); and wherein the injection shaft (1003) is disposed in the pump shaft sleeve 1002, one end of the pump shaft sleeve 1002 is in a sealing connection with the sealing device 1006 such that one end face of the injection shaft 1003, the inside wall of the pump shaft sleeve 1002 and the sealing device 1006 form a first cavity, while the other end face of the injection shaft 1003, the inside wall of the pump shaft sleeve 1002 and the inner bottom face of the cylindrical hole on the housing 1001 form a second cavity, the injection shaft 1003 can axially move back and forth in the pump shaft sleeve 1002, thereby changing volumes of the two cavities.

2. The digital ink supply system for a press according to claim 1, wherein the ink demand is calculated through the product of dot area and a required ink layer thickness integrated over dots on a printing plate of the printing press.

3. The digital ink supply system for a printing press according to claim 1, wherein the process management module reads in the image data in bitmap format of the respective color plates that are generated after RIP color separation, calculates and obtains the ink demand of each one of the ink zones on a printed sheet, and transmits the calculated ink demand of each one of the ink zones on a printed sheet to the digital ink duct of the corresponding single color printing unit.

4. The digital ink supply system for a printing press according to claim 1, wherein starting from the ink tank, the ink is isolated from the air during the process of flowing to the ink outlets of each corresponding one of the ink delivery pipes via the main ink pipe and metering-type ink delivery devices, and the whole delivery pipeline is in the positive pressure state inside.

5. The digital ink supply system for a printing press according to claim 1, wherein the process management module is capable of reading image data, calculates and obtains the ink demand of each one of the ink zones of each one of the color plates of a single printed sheet according to the image data, and then transmits the ink demands to each corresponding one of the digital ink ducts via the communication network; each one of the digital ink ducts supplies ink accurately in a metered way according to the ink demand; each one of the digital ink ducts acquires the running data of the printing press through each corresponding one of the signal acquisition devices; each one of the controllers respectively sets an ink flow rate for each corresponding one of the metering-type ink delivery devices in each corresponding one of the digital ink ducts and performs adjustment in real time according to the running speed of the printing press; in the printing process, image data in bitmap format of the corresponding color plates that are generated after RIP color separation are used to manufacture printing plates, while the printing plates are installed in the printing press; at the same time, the process management module reads in the image data in bitmap format of the corresponding color plates, calculates and obtains the ink demand of each one of the ink zones on a printed sheet, and transmits the calculated ink demands to the corresponding controllers for storage via the communication network; each one of the signal acquisition devices continuously monitors the field signal and data of the printing press, and transmits the signal data to the process management module and each corresponding one of the controllers in real time via the communication network; when the printing press performs the printing operation practically, each one of the controllers drives each corresponding one of the metering-type ink delivery devices to deliver ink to each corresponding one of the ink zones according to the respective set flow rate, and adjusts the flow rate of each corresponding one of the metering-type ink delivery devices according to the printing speed; and when the printing press stops printing, each one of the controllers stops the ink delivery action of each corresponding one of the metering-type ink delivery devices.

* * * * *